US005642545A

United States Patent [19]

Howard

[11] Patent Number: 5,642,545

[45] Date of Patent: Jul. 1, 1997

[54] FITTED CRIB PADS ADAPTED TO COVER HORIZONTAL AND VERTICAL RAILS

[76] Inventor: Bridget Howard, 13400 Wilshire, Detroit, Mich. 48213

[21] Appl. No.: 645,062

[22] Filed: May 13, 1996

[51] Int. Cl.[6] ..... A47C 21/00

[52] U.S. Cl. ..... 5/663; 5/946

[58] Field of Search ..... 5/663, 424, 425, 5/922, 946; 248/345.1

[56] References Cited

U.S. PATENT DOCUMENTS

| | | | |
|---|---|---|---|
| 2,600,556 | 6/1952 | Malm | 5/663 |
| 4,710,992 | 12/1987 | Falwell et al. | 5/663 |
| 4,767,419 | 8/1988 | Fattore | 5/663 |
| 5,450,641 | 9/1995 | Montgomery | 5/663 |

*Primary Examiner*—Alexander Grosz
*Attorney, Agent, or Firm*—Patent & Trademark Services; Joseph H. McGlynn

[57] ABSTRACT

A crib pad comprising a loop of polyurethane foam with a slit down the longitudinal extent which forms a cushion. A covering, preferably of heat welded vinyl, which forms an enclosure containing the foam cushion. Vertical pad members are secured by a connecting piece to a pad member with a longitudinal extend normal to that of the vertical members. Hook and loop type fasteners along the lateral edges of the pad members form the attachment means. A storage pocket is formed on the outer surface of the pad members by a planar piece of material secured at its edges to the covering.

6 Claims, 1 Drawing Sheet

FITTED CRIB PADS ADAPTED TO COVER HORIZONTAL AND VERTICAL RAILS

BACKGROUND OF THE INVENTION

The present invention relates generally to a rail pad for a child's crib or playpen, and particularly to a durably constructed, convenient pad that provides coverage for horizontal and vertical rail members.

DESCRIPTION OF THE PRIOR ART

Various types of pads for the rails of beds, cribs, and the like have been disclosed in the prior art. These inventions have been aimed at preventing injuries that can occur when an infant or bed patient fails against or otherwise comes in contact with the rigid frame members of the bed or crib structure.

U.S. Pat. No. 2,600,556 describes a pad for cribs and playpens, constructed of a fabric covered length of padding with a plurality of fasteners and ties. This invention, however, is deficient in several respects. First, it does not cover the corners or vertical rails of the crib, which are just as dangerous as the upper horizontal rail that the invention is designed to cover. Also, the plurality of fasteners makes it time consuming to install and remove, and the tie fasteners could be dangerous if pulled off and swallowed by an infant.

Other prior art inventions suffer from similar shortcomings. For example, U.S. Pat. No. 4,710,992, describes a pad primarily for use on waterbeds, however, it is not suitable for use on cribs or playpens. This invention employs metal clips which might be removed by the infant, posing obvious hazards. Moreover, this invention does not provide coverage for vertical rails or corners.

U.S. Pat. No. 4,767,419, discloses a crib rail made of plastic-covered foam, which uses a multitude of time-consuming fasteners and similarly does not provide for vertical rail coverage.

U.S. Pat. No. 5,450,641, which describes a rail cover for use on hospital beds suffers from the same type of disadvantages.

There remains a need for a crib rail cover that provides safe covering of both the horizontal and vertical members of the crib structure. Moreover, there is much room for improvement in terms of the convenience, durability, and aesthetic quality of the inventions heretofore disclosed.

SUMMARY OF THE INVENTION

The present invention is an improved pad for the rails of cribs and playpens. This invention represents an improvement over prior art pads in that it can be applied to cover the vertical as well as horizontal rail members of crib frames. Moreover, it employs a vinyl covering over a padded center, which allows for easier cleaning and enhanced durability. It can be easily and quickly installed and removed because it features a hook and loop type fastener, more commonly known by the brand name "Velcro". The invention also features pockets which can be used to store toys and other baby items.

The invention comprises a length of extruded polyurethane foam tubing which has a slit down the longitudinal extend to form an opening into which the rail of a crib may be received. The foam is covered by vinyl sheets that are die cut and electronically heat welded together at the edges. Hook and loop type closures are connected at the opposing lateral edges of the crib pad to provide the means of securing the pad to the rails.

Each such pad is connected at the upper end to another pad having a longitudinal extend generally normal to that of the first. The invention thus forms a series of T-shaped configurations useful for covering both vertical and horizontal frame members of a crib or playpen.

Accordingly, it is an object of the present invention to provide an improved padding for cribs and playpens.

It is also an object of this invention to provide a padding that is durably constructed, attractive, and convenient to use.

It is a further object of this invention to provide a padding that can be used to cover both vertical and horizontal frame members of cribs and playpens.

These and other objects and advantages of the present invention will become fully apparent from the detailed description below, when taken in conjunction with the annexed drawings.

DESCRIPTION OF THE PREFERRED EMBODIMENT

Figure 1:
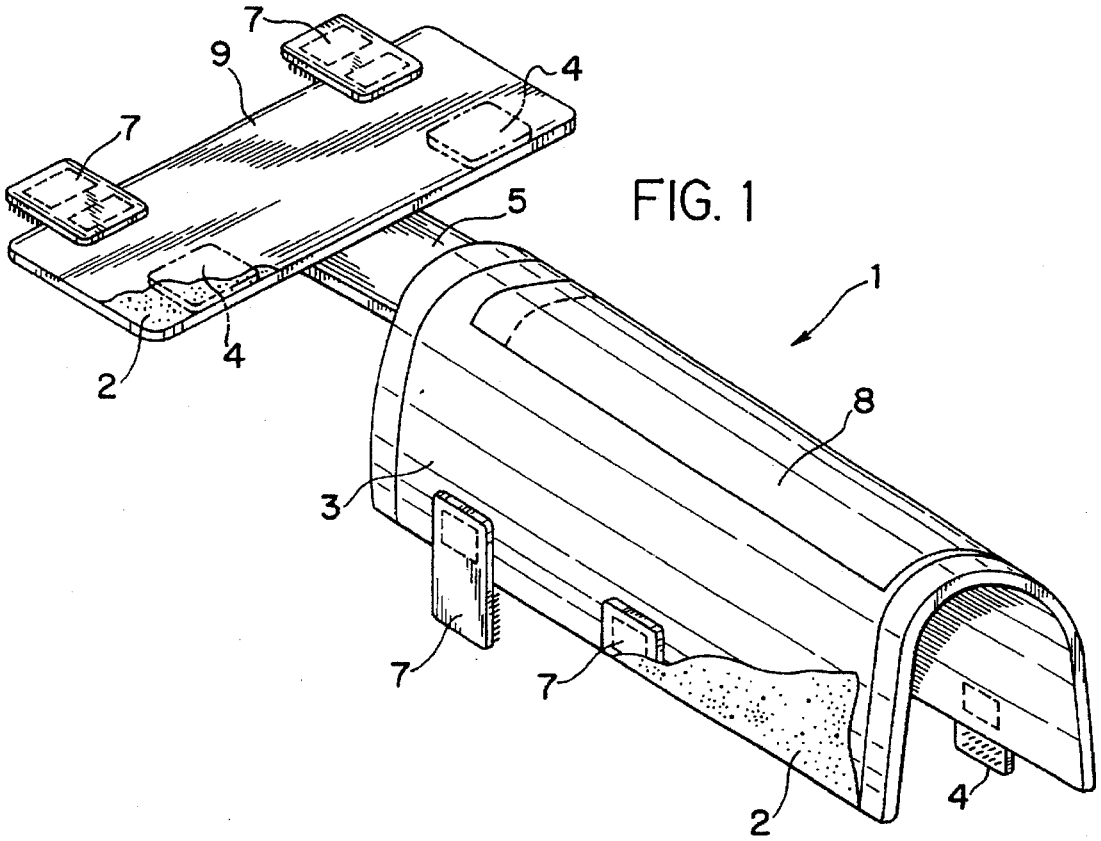
FIG. 1 shows a perspective view of the present invention, with sections cut away to show the construction thereof.

Referring now to the drawings in greater detail, it can be seen in FIG. 1 that the present invention 1 comprises pads 3, 9, each having internal cushions or padding 2, which are preferably formed from a loop of extruded polyurethane foam tubing with a slit down the longitudinal extent thereof. Of course, materials comparable to polyurethane foam may be used without departing from the scope of the invention. The critical factor for the material is that it should be soft enough to prevent injuries to a baby in the crib.

Each cushion or pad 2 has a covering constructed from planar pieces of material connected at the edges to form an enclosure conforming to the cushion 2. The preferred material for the covering 3 is vinyl, though other materials may be used without departing form the scope of the invention. Suitable materials would include any which are durable, inexpensive, and easy to clean. However, as described in more detail below, vinyl is preferable for the additional reason of its amenability to the manufacturing process of heat welding.

A plurality of connection means, shown in FIG. 1 as a hook and loop type fasteners 4, 7 are disposed along the lateral edges of each pad 3, 9. The inside surface of each fastener 4, 7 is detachably securable to the outside surface of each corresponding fastener on the opposing lateral edge of the pads 3, 9. The hook and loop variety of fastener, commonly known as "Velcro", is preferable for its convenience and simplicity. However, other comparable fastening means may be used without departing from the scope of the invention.

Figure 2:
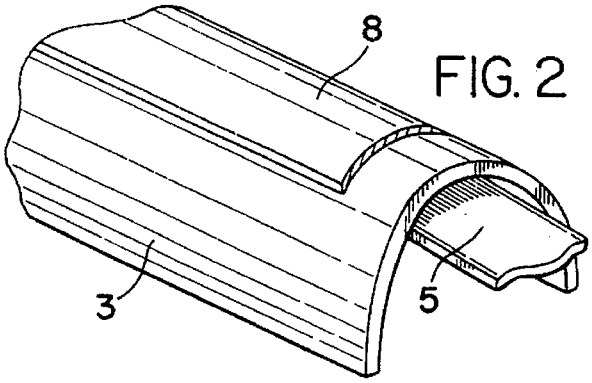
FIG. 2 shows a fragmentary detail view of the structure shown in FIG. 1.
Figure 3:
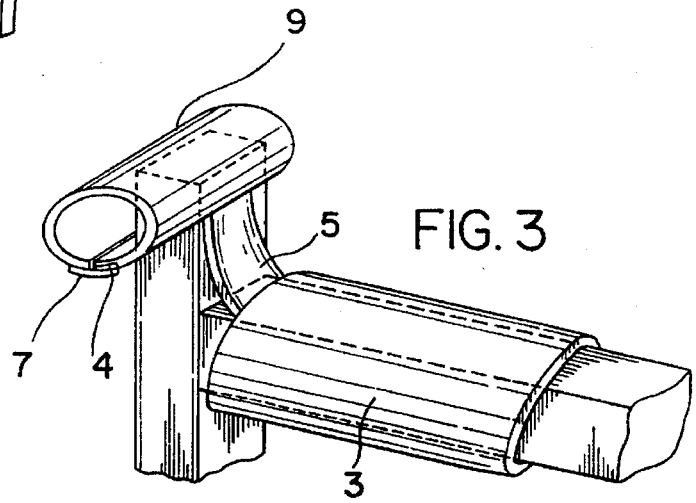
FIG. 3 shows the pads, without the fasteners and pocket, attached to a crib.

As can be seen in FIGS. 1 and 2, the pads 3, 9 are attached by a connector piece 5, such that the longitudinal extend of one pad 3 is generally normal that of the other pad 9. The connector piece can consist of a planar strip of vinyl, or some similar material, and may be stitched or otherwise securely fastened to the pads 3, 9. In the alternative, the connector piece 5 could be detachably connected to the pads 3, 9 with fasteners such as, but not limited to, Velcro hook and loop fasteners. This would provide more versatility in attaching the pads to various sizes of cribs. For example, several sections of pad 3 could be attached to a long crib rail with the pads 9 attached only to the ends where the vertical rails are positioned.

A pocket 8 is formed on the outer surface of at least one pad 3 by a piece of material secured at its outer edges to the outer covering of the pad 3. The pocket may be used to store a variety of items, including but not limited to, toys, baby wipes, and pacifiers.

As noted above, the preferred material for the construction of the outer covering is vinyl. This material is particularly suitable for its amenability to the process of heat welding, which can be employed to created a leak-proof seam at the edges of the outer covering. Since vinyl can not be glued together, electronic heat welding is the process of choice. Electronic heat welding is a process which uses high-frequency waves that are brought to bear on a mechanical "horn", which mechanically vibrates at the same frequency provided to it by an electronic circuit. The vibrations are so fast and powerful, they generate frictional heat in the connection that the horn is pressed against. The connection heats to the point where it is melted or welded together. The heat welding type of connection is strong enough to provide a leak proof seam in the outer covering which will protect the material of the crib rails from spills.

This same type of process could be used as well to connect the Velcro hook and loop fastener attachments 4 and 7, the connector piece 5, and the pocket 6 to their respective parts.

To use the invention, the pads 3, 9 are fitted over the vertical and horizontal frame members of a crib or playpen. The fastening means 4, 7 are then secured. Depending on the size and structure of the crib, a number of pads 3 may be fitted as needed. The invention provides safety and security by softening the impact of the infant's contact with the structure of the crib. It also can be employed to reduce the space between the frame members of the crib to prevent the infant from becoming stuck therein. The invention is readily detachable for easy cleaning and also provides the convenience of pocket storage of baby items.

Although the crib pad and the method of using the same according to the present invention have been described in the foregoing specification with considerable details, it is to be understood that modifications may be made to the invention which do not exceed the scope of the appended claims and modified forms of the present invention done by others skilled in the art to which the invention pertains will be considered infringements of the present invention when those modified forms fall within the claimed scope of the invention.

What I claim as my invention is:

1. A protective pad assembly (1) for use with a structure having at least one horizontal rail and at least one vertical rail, said pad assembly comprising:

an inverted U-shaped body comprising two arms (3) and a top portion interconnecting said arms, said body made up of two interconnected outer parts with a soft material (2) positioned between said outer parts, fastening means (4, 7) spaced along said arms, whereby said fastening means (4, 7) are adapted to be connected together to fasten said body to said at least one horizontal rail, a second body (9) made up of two interconnected outer parts with a soft material (2) positioned between said outer parts, said second body connected to one end of said inverted U-shaped body, said second body having a longitudinal axis which is perpendicular to a longitudinal axis of said inverted U-shaped body, said second body having fastening means (4, 7) spaced therealong, whereby said fastening means on said second body are adapted to be connected together to fasten said second body to said at least one vertical rail.

2. The protective pad assembly as claimed in claim 1, wherein said inverted U-shaped body and said second body are integrally connected together.

3. The protective pad assembly as claimed in claim 1, wherein said top portion of said inverted U-shaped body has a pocket formed integrally therewith.

4. The protective pad assembly as claimed in claim 1, wherein said outer parts of said inverted U-shaped body and said second body are made from plastic.

5. The protective pad assembly as claimed in claim 4, wherein said plastic is vinyl.

6. The protective pad assembly as claimed in claim 1, wherein said soft material positioned between said outer parts of said inverted U-shaped body and said second body is extruded polyurethane foam.

* * * * *